US006109956A

United States Patent [19]

Kawase et al.

[11] Patent Number: 6,109,956

[45] Date of Patent: Aug. 29, 2000

[54] FITTING DETECTING CONNECTOR

[75] Inventors: Hajime Kawase; Satoru Nishide; Ryotaro Ishikawa, all of Yokkaichi, Japan

[73] Assignee: Sumitomo Wiring Systems, Ltd., Japan

[21] Appl. No.: 09/129,129

[22] Filed: Aug. 4, 1998

[30] Foreign Application Priority Data

Aug. 5, 1997 [JP] Japan ..... 9-211020

[51] Int. Cl.[7] ..... H01R 3/00

[52] U.S. Cl. ..... 439/489; 439/354

[58] Field of Search ..... 439/488, 489, 439/352, 353, 354, 356, 357, 358

[56] References Cited

U.S. PATENT DOCUMENTS 5,183,410 2/1993 Inaba et al. ..... 439/489
5,938,470 8/1999 Kashiyama ..... 439/489

FOREIGN PATENT DOCUMENTS 774804 5/1997 European Pat. Off. .
2308755 7/1997 United Kingdom .

OTHER PUBLICATIONS

Japanese Abstract Vol. 1997, No. 12, Dec. 25, 1997, JP09219256.

*Primary Examiner*—Steven L. Stephan
*Assistant Examiner*—Eugene G. Byrd
*Attorney, Agent, or Firm*—Banner & Witcoff, Ltd.

[57] ABSTRACT

When two connector housings are half-fitted together, a fitting detecting connector causes one of the connector housings to be pushed in a direction of separation by means of springs which are provided within a female connector housing, a spring holder being inserted into this female connector housing so that it can move in an anterior-posterior direction. This spring holder houses springs and, when the two connector housings are being fitted together, a locking arm rises over a stopping protrusion. As a result of the locking arm rising, the spring holder is restrained, its movement in a posterior direction is regulated, and the springs are compressed. When the connector housings are completely fitted together the locking arm springs down, releasing the spring holder, and allowing it to move in a posterior direction under the spring force. All of the half-fitting detector components are provided on one of the connector housings; the other connector housing requires no modification.

13 Claims, 8 Drawing Sheets

FITTING DETECTING CONNECTOR

TECHNICAL FIELD

The present invention relates to an electrical connector having means to detect correct fitting of the two connector housings.

BACKGROUND TO THE INVENTION

Conventional fitting detecting connectors have a spring built into one of the connector housings which is compressed during fitting. If the fitting operation halts before the two connector housings are completely fitted together, the corresponding connector housing is pushed out by the spring, and this informs the operator that correct fitting has not been achieved.

However, in a completely fitted state, the spring force continually acts on the corresponding side so that a force to separate the two housings is constantly exerted. This is not desirable. Accordingly, connectors have been developed in which the spring is compressed during the fitting operation and reverts to its original shape when the fitting is complete, thus releasing the spring force. For example, one such connector is described in Japanese patent publication No. 306575/92.

In this case, where the spring detects the completely fitted state and is then released, the easiest configuration to adopt is one in which the fitting detection is carried out by using the movement of a locking arm. In such cases, as is the case in the publication mentioned above, the locking arm and the spring are arranged in a distributed manner, so that locking arm is located in one connector, and the spring is located in the other.

Accordingly, in order to realise this kind of detecting connector, a necessary constituent of each connector housing is at least a locking arm or a spring. However, this places constraints on the configuration of the connector housings. For example, if an existing connector housing is to be replaced with one of a fitting detecting type, major design changes will have to be carried out on both the male and female connector housings.

The present invention has been developed after taking the above problem into consideration, and aims to present a fitting detecting connector which has a greater degree of freedom of design.

SUMMARY OF THE INVENTION

According to the invention there is provided a fitting detecting connector having a housing, a bendable latch arm on the housing and engageable over a protrusion of a mating connector, and resilient means having a reaction member provided in said housing, said resilient means being engageable by a mating connector to push apart said detecting connector and a mating connector until said latch arm is in use engaged, characterized in that said connector further includes a spring holder on said housing and movable relative thereto, said spring holder defining said reaction member and being fixed relative to said housing only when said latch arm is in the bent condition.

Such a connector includes means for detecting correct fitting but does not require special adaptation of the mating connector. This is particularly advantageous where the mating connector is an integral part of other apparatus, and for example moulded therewith.

Preferably the spring holder is slidable with respect to the connector housing, and the resilient means comprises coil springs arranged preferably on either side of the latch arm. Retention means may be provided to hold the spring holder with respect to the housing until a mating connector is introduced, the spring holder thereafter being released and subsequently operating according to claim 1 thereof.

BRIEF DESCRIPTION OF DRAWINGS

Other features of the invention will be apparent from the following description of a preferred example shown by way of example only in the accompanying drawings in which.

DESCRIPTION OF PREFERRED EMBODIMENT

Figure 1:
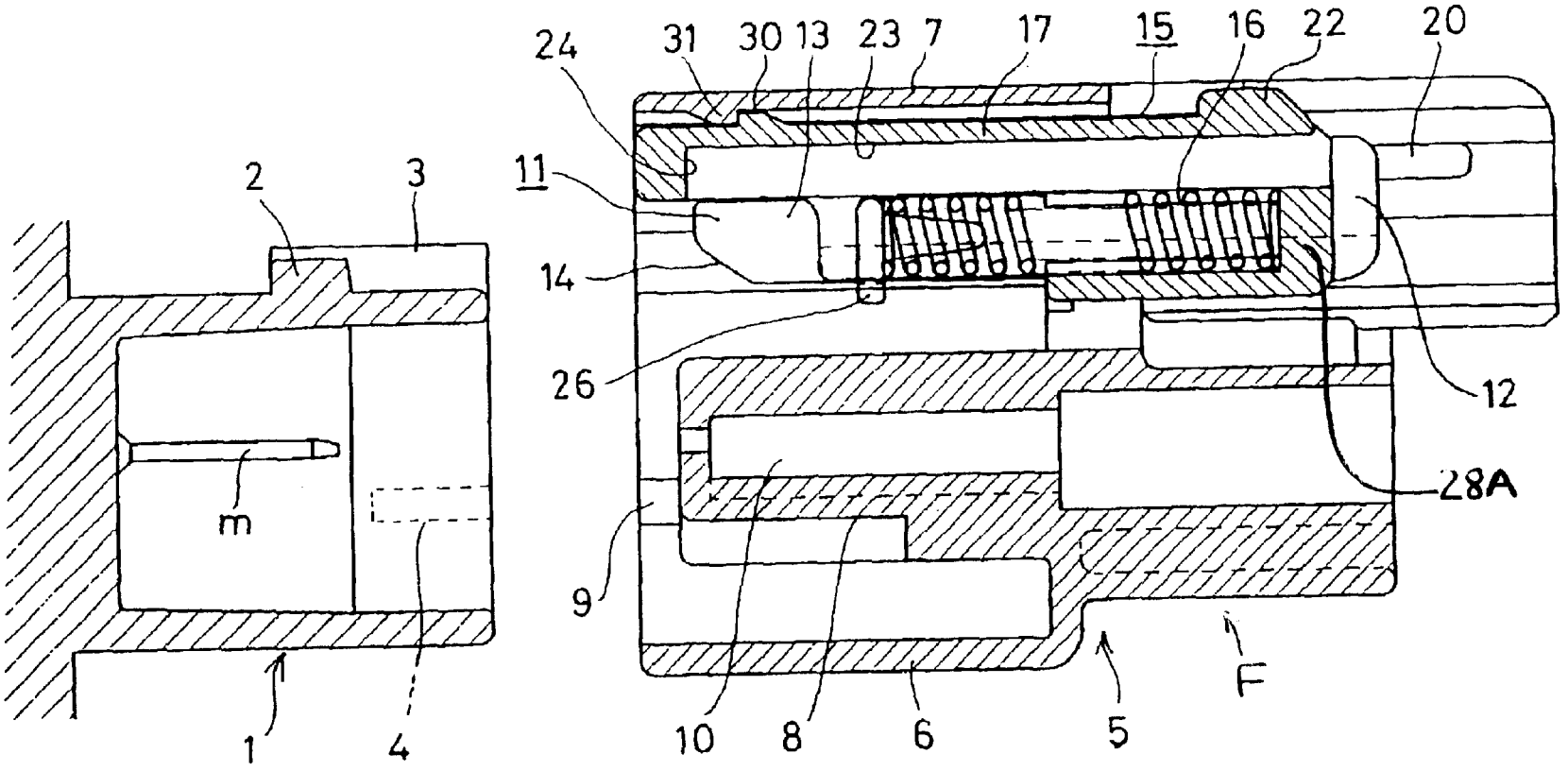
FIG. 1 is a cross-sectional view of two connector housings prior to their being fitted together.

An embodiment of the present invention is described below with the aid of FIGS. 1 to 16. In FIG. 1, a male connector housing 1 is part of an electrical apparatus. This male connector housing 1 is of an approximately angular tubular shape, is open at the front, and its interior houses a male terminal fitting m. A stopping protrusion 2 protrudes from its upper face at a location close to its anterior edge. Ribs 3 is provided on both sides of the stopping protrusion 2 and extend in a parallel fashion from the opening edge of the male connector housing 1 to the posterior edge of the stopping protrusion 2.

A pair of guiding protruding edges 4 are formed on both side faces of the male connector housing 1 in order to prevent twisting when a female connector housing 5 is fitted. This male connector is conventional.

Next, an explanation is given of a female connector F having a housing 5 which can be fitted to the male connector housing 1 described above. The male and female connector housings are each formed in a unified manner from synthetic resin, and the anterior half of the female connector housing 5 is larger than the posterior half, and is open towards the anterior side forming an external cylinder member 6. The central portion of the upper face of the external cylinder member 6 protrudes in an upper direction and forms an archlike bridge member 7.

A terminal housing member 8 is formed within the interior of the external cylinder member 6 to house female terminal fittings (not shown). The male connector housing 1 can be fitted between the terminal housing chamber 8 and the external cylinder member 6. Guiding groves 9 protrude from both side faces of the external cylinder member 6 and, by receiving the guiding protruding edges 4 of the male connector housing 1, guide the two connector housings during fitting.

Figure 2:
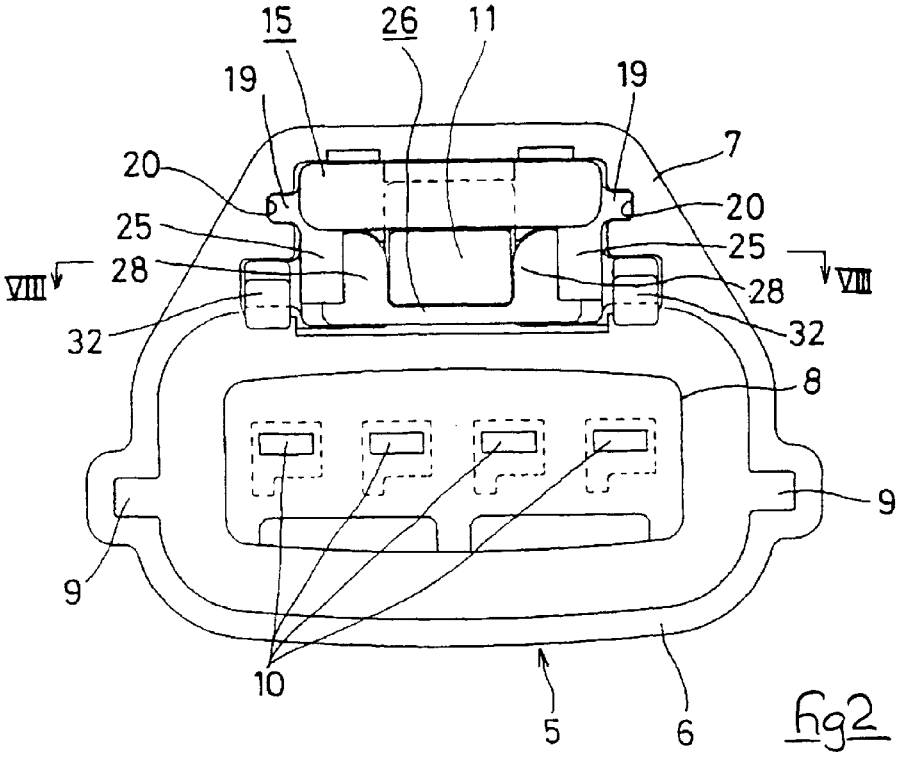
FIG. 2 is a front view of a female connector housing.

As shown in FIG. 2, the terminal housing member 8 is provided with four terminal housing chambers 10 which are aligned in a parallel manner in a width-wise direction, and at a specified distance from one another. Each terminal housing chamber 10 passes through from the anterior to the posterior, and can house the female terminals in an unremovable state. When the male connector housing 1 and the female connector housing 5 are in a completely fitted state, the male and female terminals are connected electrically.

Figure 3:
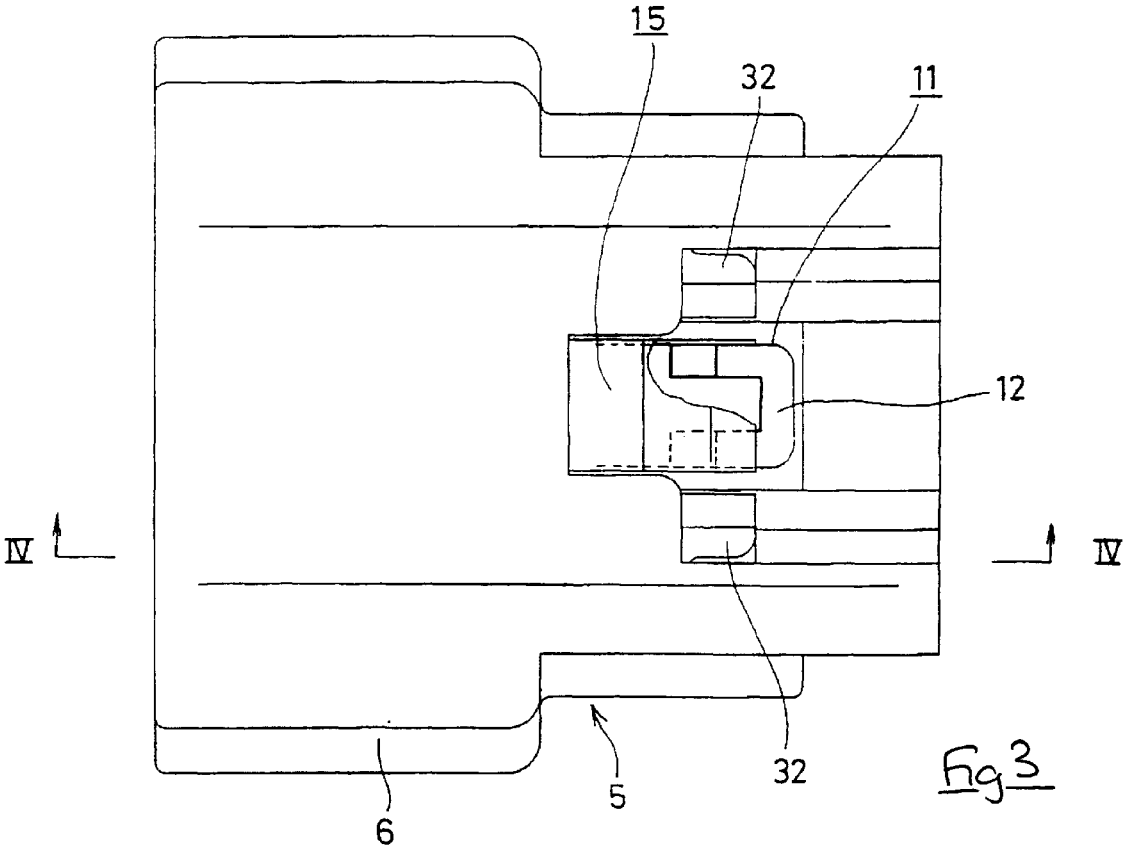
FIG. 3 is a plan view of the female connector housing.
Figure 4:
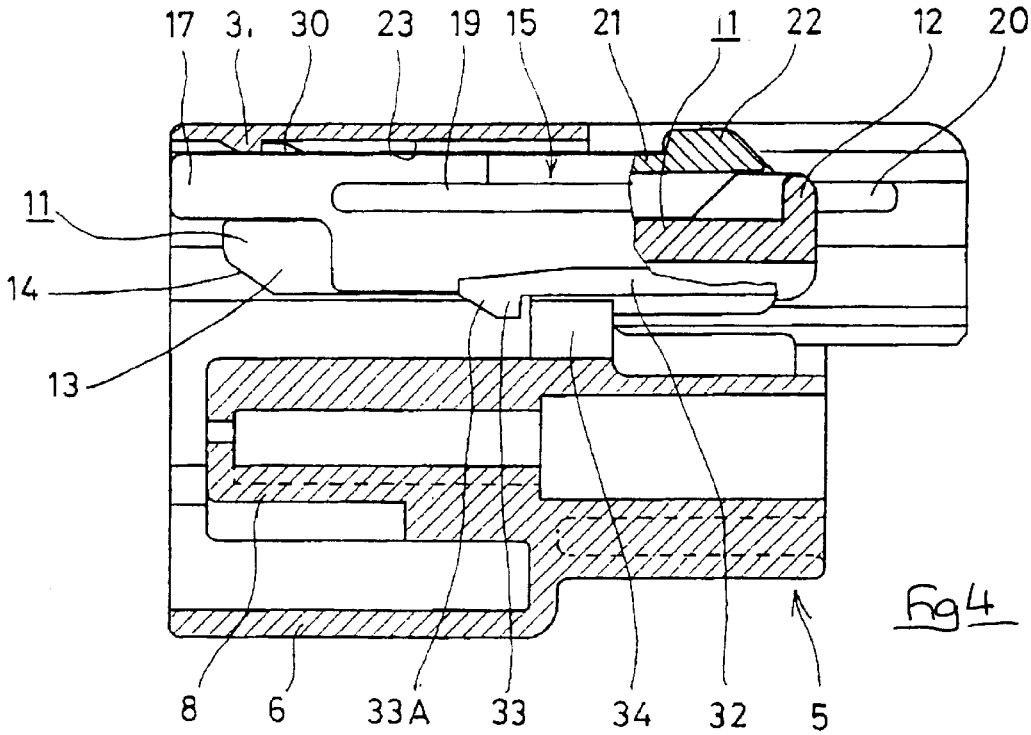
FIG. 4 is a cross-sectional view of FIG. 3 along the line IV—IV.
Figure 5:
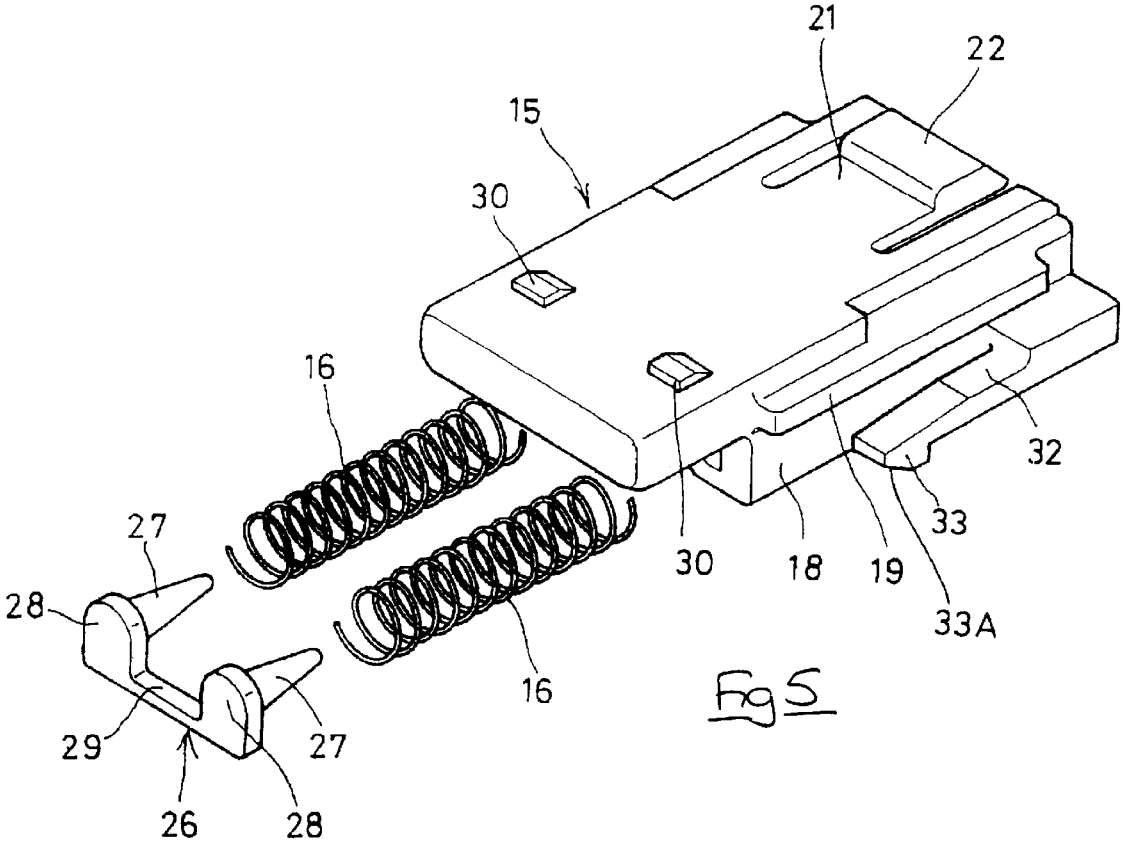
FIG. 5 is an exploded diagonal view of a spring holder.

A locking arm 11 is provided on the upper face of the terminal housing member 8 to support the two connector housings in a fitted state, the anterior half thereof extending into the bridge member 7, and the upper face of the posterior end thereof having a rising edge 12 shaped like a back to front C which follows along its external edge (see FIGS. 3 and 4). The approximately central portion of the locking arm 11 is joined to the upper face of the terminal housing member 8 and the locking arm 11 can be moved in a seesaw fashion in the anterior and posterior directions. The anterior end of the locking arm 11 as a hook shaped locking claw 13. When the two connector housings are in a completely fitted state, this locking claw 13 fits with and is retained by the stopping protrusion 2. In addition, the anterior end face of the locking claw 13 has a tapered face 14 which tapers towards the inner side, and which allows the locking claw 13 to rise smoothly over the stopping protrusion 2 in the engagement direction.

A spring holder 15 is formed on the female connector housing 5 to cover the locking arm 11 (see FIGS. 5 to 8). When this spring holder 15 contains coiled springs 16 (to be described later), the two are treated as a single unit, and the spring holder 15 and the coiled springs 16 are contained as a single unit within the female connector housing 5. The spring holder 15 has a plate like base plate member 17. A pair of spring housing members 18 extend from front to rear on the left and right sides of the lower face of this base plate member 17 and serve to encompass the locking arm 11.

A pair of guiding rails 19 extend for a specified length along both sides of the spring holder 15 from a position part-way along the sides of the spring holder 15 towards the rear. Grooves 20 provided on the inner face of the bridge member 7 correspond with the guiding rails 19, and allow the guiding rails 19 to be fitted in such a way that they can slide. The guiding rails 19 extend from the anterior end face of the bridge member 7 in an anterior-posterior direction for a specified length. When the spring holder 15 is fitted into the female connector housing 5, the stroke of the guiding rails 19 in the posterior direction is regulated by the posterior edge location of these grooves 20.

Figure 6:
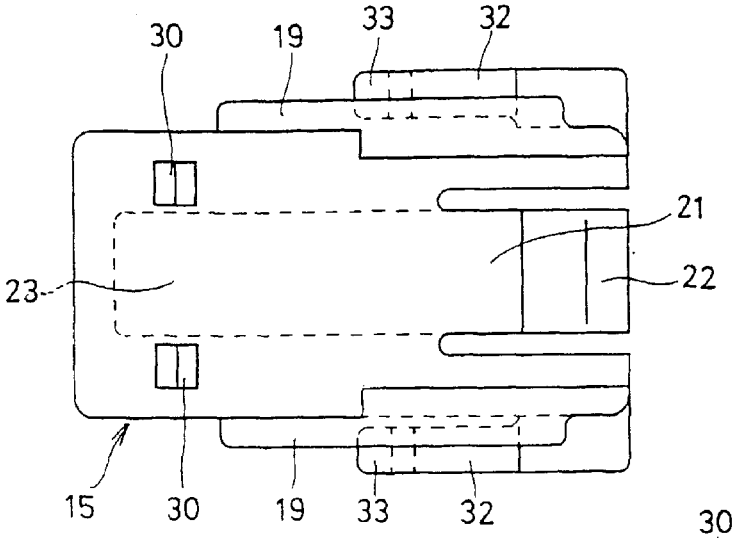
FIG. 6 is a plan view of the spring holder.
Figure 7:
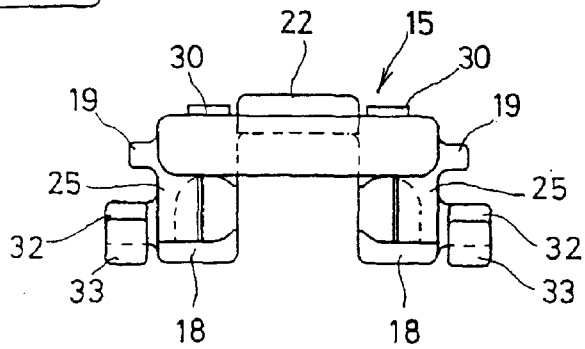
FIG. 7 is a front view showing a single spring holder prior to its being fitted with a coiled spring.

The spring holder 15 is usually fitted so that it covers almost the entire length of the locking arm 11 with only the posterior end portion of the locking arm 11 protruding slightly. A releasing operating member 21 is formed on the posterior edge of the locking arm 11, that is, on the portion on which the rising edge 12 is formed and which corresponds to the lock releasing side, this releasing operating member 21 allowing the lock release of the locking arm 11 to be carried out. The anterior end portion of the releasing operating member 21 is higher and forms a stepped member 22. As shown in FIG. 6, cuts have been made along both sides of the releasing operating member 21 which allow it to bend in an up-down direction. Additionally, as shown in FIG. 4, the lower face of the releasing operating member 21 is usually in contact with the rising edge 12 of the locking arm 11 and allows a pushing-in operation to be performed on the locking arm 11.

The inner face of the base plate member 17 has the same width as the releasing operating member 21 and has a recess 23 set back from the anterior edge. This recess 23 allows the locking arm 11 to bend when it rides over the stopping protrusion 2 while the two connector housings are being fitted together. The anterior end of the base plate member 17 forms a restraining wall 24 which stops the anterior end of the locking member 11 and regulates the retreating operation of the spring holder 15 (explained in detail later).

Figure 8:
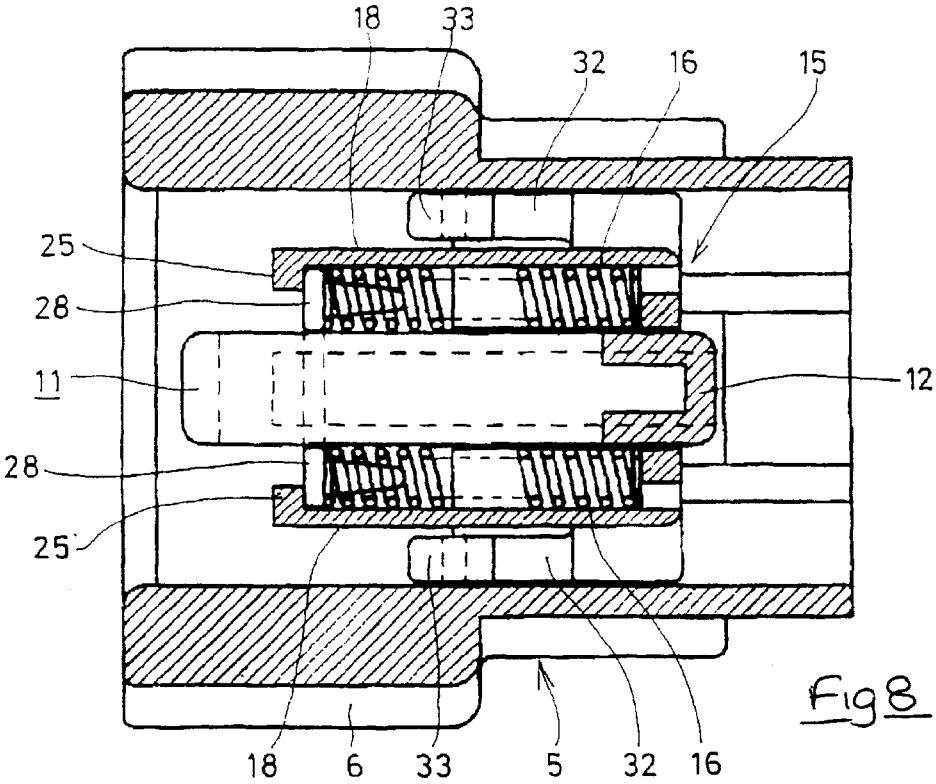
FIG. 8 is a cross-sectional view of FIG. 2 alone the line VIII—VIII.

The interior of each spring housing member 18 houses a coil spring 16 horizontally and in an approximately natural state. Further, only half of the anterior face of the spring housing member 18 is open. That is, a pair of halting members 25 are formed on the anterior ends of the spring housing members 18, these halting members 25 covering half of the external face of each spring housing member 18 (FIG. 8). The anterior ends of the two coiled springs 16 are equipped with a spring pushing member 26 which comprises a pair of spring seats 28, each of which has an axis member 27 which projects into the coiled spring 16, and a joining member 29 which links the spring seats 28. This spring pushing member 26 links the coiled springs 16 and allows them to expand and contract together. The spring seats 28 come into contact with the inner side of the halting members 25 and the removal of the coiled springs 16 is thereby prevented. The portion of the spring seats 28 which protrude from the halting members 25 corresponds to the location of the ribs 3 of the male connector housing 1 when the male and female connector housings are being fitted together. As a result, while the fitting is taking place the ribs 3 compress the coiled springs 16 via the corresponding spring seats 28 and onto a rear reaction member 28A.

Figure 11:
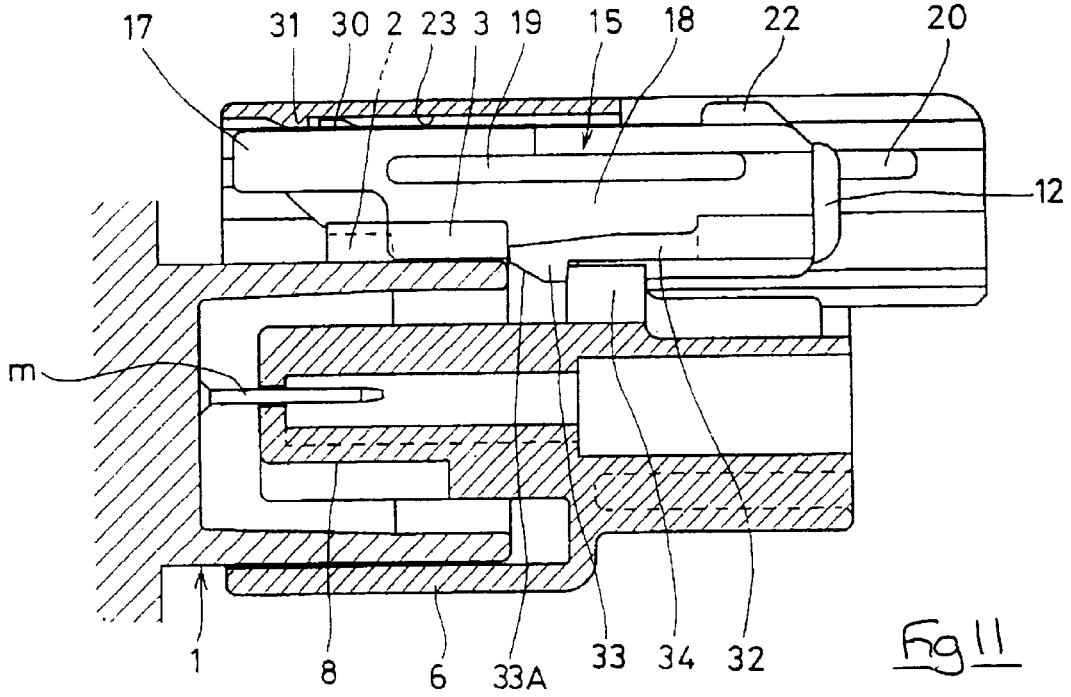
FIG. 11 is a cross-sectional view showing a supporting arm in contact with a male connector housing.
Figure 13:
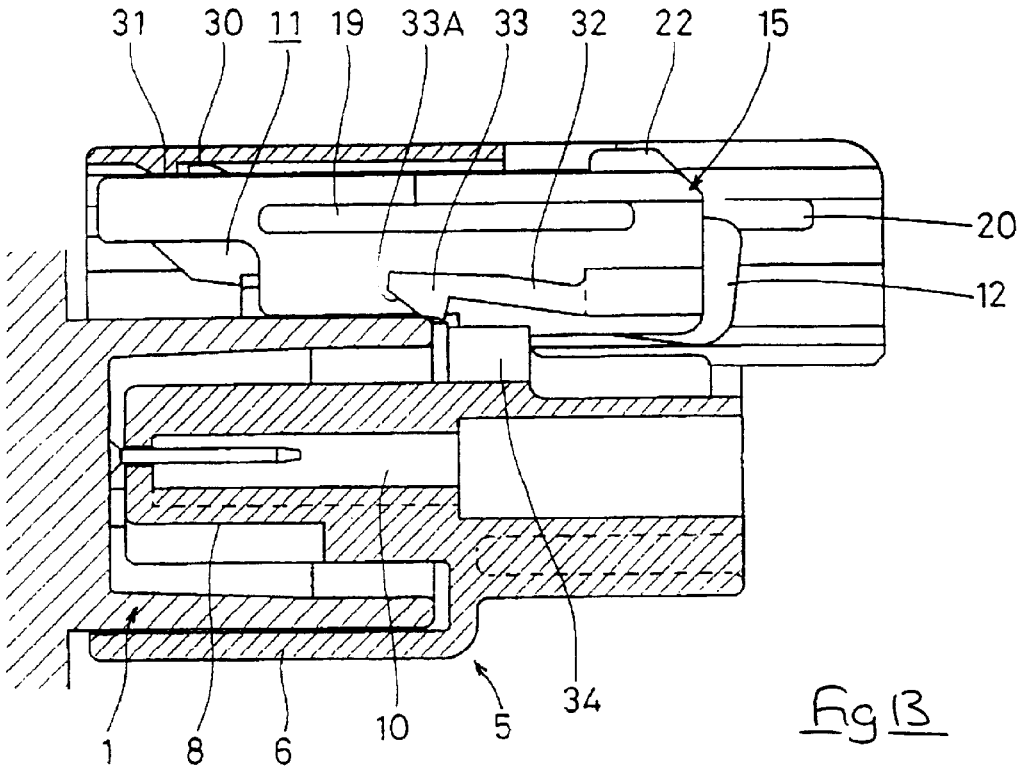
FIG. 13 is a cross-sectional view showing the supporting arm separated from the hook member.
Figure 14:
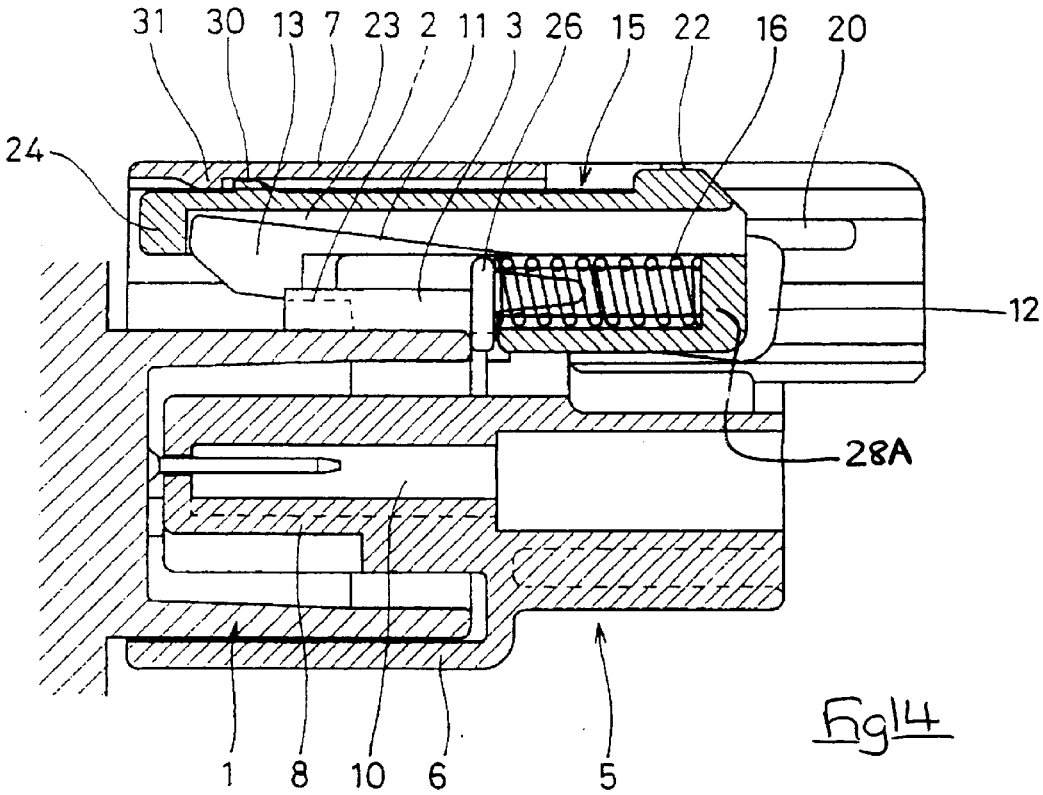
FIG. 14 is a cross-sectional view showing the movement of the supporting arm at the same juncture as the state shown in FIG. 13.
Figure 15:
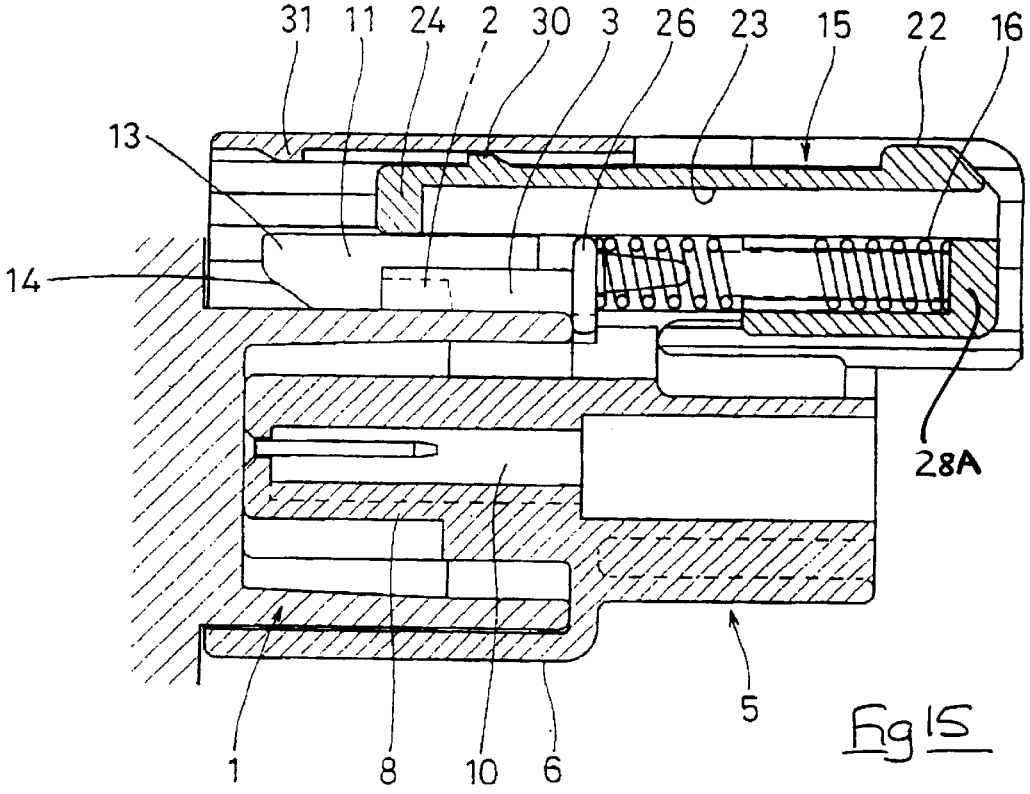
FIG. 15 is a cross-sectional view showing a completely fitted state.
Figure 16:
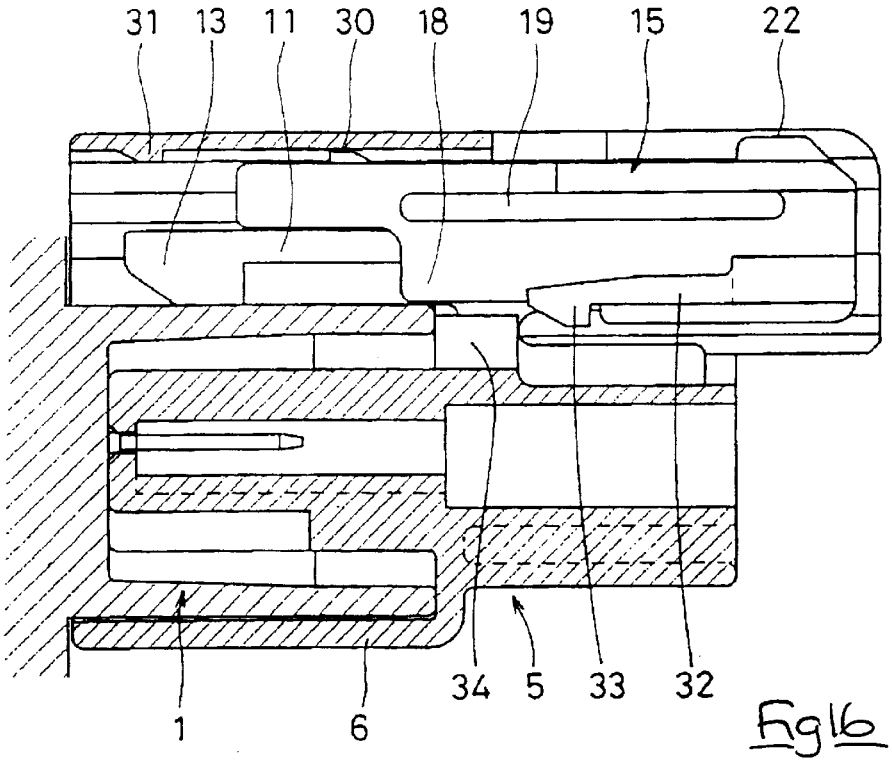
FIG. 16 is a cross-sectional view showing the supporting arm during the completely fitted state.

A pair of left and right protrusions 30 are formed on the upper face of the base plate member 17 close to the anterior end thereof. These protrusions 30 fit with stopping protruding members 31 formed on corresponding locations of the ceiling face of the bridge member 7 and fix the position in an anterior direction of the spring holders 15. A pair of supporting arms 32 protrude from the outer side faces of the two spring housing members 18. The base ends of the supporting arms 32 are located at the posterior end of the spring holder 15 and the supporting arms 32 extend horizontally in an anterior direction along the side walls of the spring housing members 18 and have a cantilevered shape, the anterior ends thereof being provided with retaining claws 33. The supporting arms 32 can be bent in an up-down direction, and can be removably retained by a pair of hook members 34 located in a corresponding position on the upper face of the terminal housing member 8. In this manner, the spring holder 15 is retained from being removed in the posterior direction. As shown in FIGS. 11 and 13, the claws 33 of the supporting arms 32 make contact with the anterior edge of the male connector housing 1 and, as the two connector housings are fitted together, the retention of the hook members 34 is released. This retention is released when the connector housings are completely fitted together, and is arranged to occur just before the retention of the spring holder 15 by the locking arm 11 is released (see FIG. 14). The claws 33 are provided with tapered faces 33A so that this releasing operation can be performed smoothly.

Figure 9:
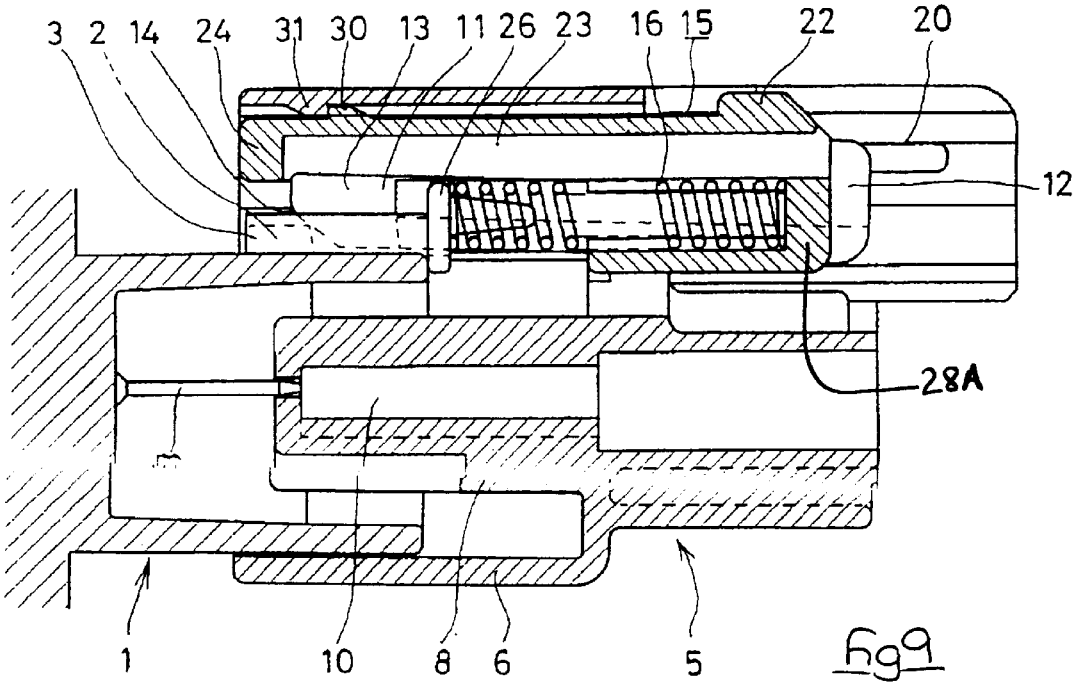
FIG. 9 is a cross-sectional view showing a locking arm in contact with a stopping protrusion.

Next, the operation and effects of the present embodiment, configured as described above, are explained. When the male and female connector housings are to be fitted together they are made to face one another with the guiding protruding edges 4 of the male connector housing 1 and the guiding grooves 9 of the female connector housing 5 being brought together. Then the female connector housing 5 is pushed onto the male connector housing 1, and the locking claw 13 of the locking arm 11 makes contact with the stopping protrusion 2 of the male connector housing 1. The fitting proceeds, and, as shown in FIG. 9, slightly after the locking claws 13 and the stopping protrusion 2 make contact, the ribs 3 make contact with the corresponding spring seats 28 of the spring pushing member 26.

Figure 10:
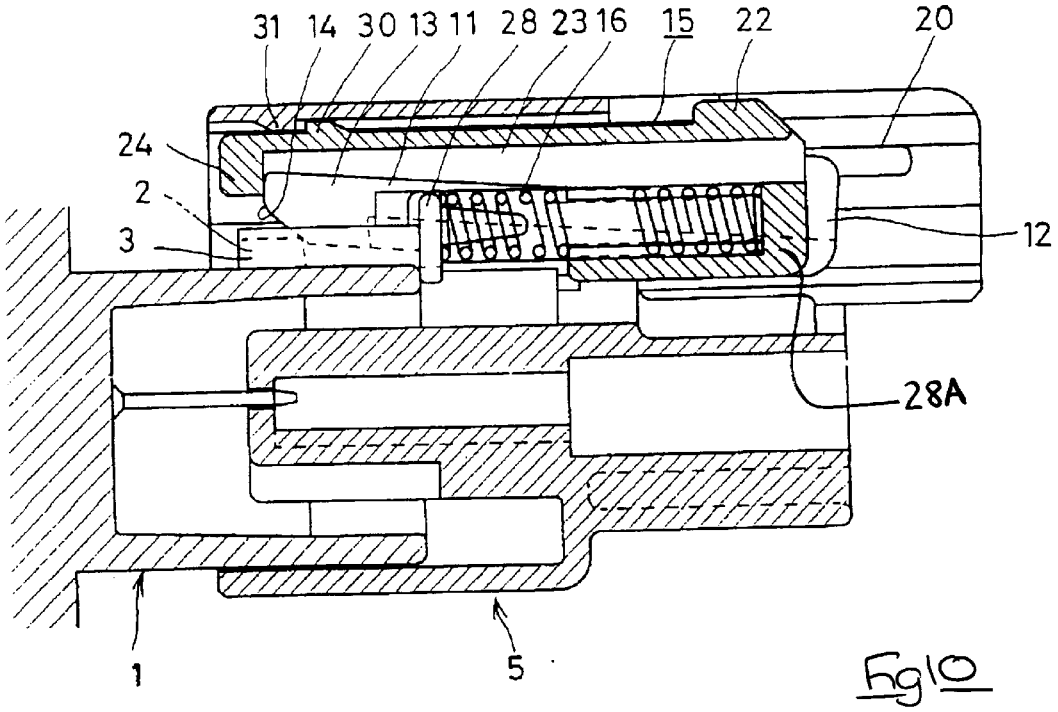
FIG. 10 is a cross-sectional view showing the locking arm which has risen over the stopping protrusion.

Then the tapered face 14 of the locking claw 13 slides along the stopping protrusion 2, thus raising that side of the locking arm 11 on which the locking claw 13 is located, and the locking claw 13 thus rises over the stopping protrusion 2 (see FIG. 10). The locking claw 13 is engaged by the restraining wall 24 of the spring holder 15 as a result of the rising of the locking arm 11.

Meanwhile, the fitting operation of the ribs 3 takes place and the coiled springs 16 are pushed in by means of the spring pushing member 26. At this juncture, as mentioned above, the spring seats 28 are engaged by the locking arm 11 and the restraining wall 24 and their movement in a posterior direction in thus regulated. Consequently the coiled springs 16 are restrained at their posterior end and, as a result, the coiled springs 16 begin to be compressed by the ribs 3 as the latter are pushed in.

Figure 12:
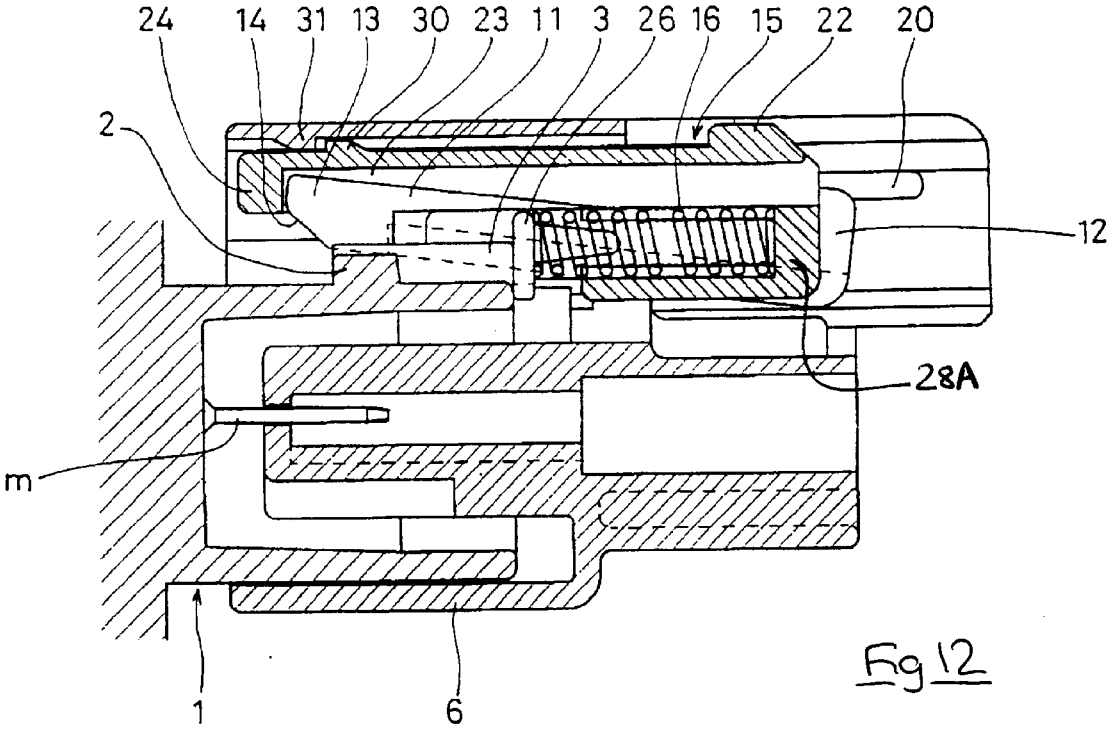
FIG. 12 is a cross-sectional view showing the movement of the locking arm at the same juncture as the state shown in FIG. 11.

During the interval preceding the regulation of the movement of the spring holder 15 by the locking arm 11, the supporting arms 32 are in a state whereby they are retained by the hook members 34. As a result, even if the coiled springs 16 are pushed in for any reason, the spring holder 15 will not retreat inadvertently (FIGS. 11 and 12).

In the state directly prior to the connector housings being completely fitted together, that is, in the state directly prior to the locking claw 13 rising over the stopping protrusion 2 (the state shown in FIG. 14), the anterior edge of the male connector housing 1 slides along the tapered face 33A of the claws 33 located on the supporting arms 32, raising the anterior ends. As a result, the claws 33 are released (see FIG. 13). This releasing operation precedes the releasing of the spring holder 15 by the locking arm 11.

Finally, the locking arm 11 rises over the stopping protrusion 2 and reverts to its original position and the locking claw 13 moves away from the restraining wall 24. Consequently, the restraint of the spring holder 15 by the locking arm 11 is released. As a result, the spring force of the coiled springs 16 pushes the spring holder 15 backwards. The guiding rails 19 of the spring holder 15 and the groove members 20 of the female connector housing 5 fit together, guiding and allowing this backwards movement to occur smoothly. The posterior end position of the groove members 20 regulates this backwards movement.

In this manner the fitting of the locking claw 13 and the stopping protrusion 2 latches the connector housings in a fitted state, and the electrical connection of the male and female terminal fittings is completed. At this juncture, the coiled springs 16 regain almost their natural length due to the posterior movement of the spring holder 15 and, as a result, do not exert a separating force on the connector housings when the latter are in a completely fitted state.

In the completely fitted state, the restraining wall 24 of the spring holder 15 is pushed over the anterior end of the locking arm 11. This constitutes a double latching of the stopping protrusion 2, and a more reliable locked state can thus be achieved.

When the two connector housings are to be separated, the coiled springs 16 are compressed and the spring holder 15 is simultaneously advanced. Meanwhile the supporting arms 32 are pushed in until they are again retained by the hook members 34. As a result the restraining wall 24 of the spring holder 15 passes the location of the anterior end of the locking arm 11 and the spring holder 15 returns to its original location and, via the edge 22 of the releasing operating member 21, pushes the rising edge 12 of the locking arm 11. The anterior end of the locking arm 11 rises up and the locking claw 13 is released from the stopping protrusion 2. In this manner the female connector housing 5 and the male connector housing 1 can be separated.

According to the present embodiment, as described above, the spring force of the coiled springs 16 separates the two connector housings if the fitting operation of the connector housings is stopped before the two are completely fitted together and a half-fitted state can be detected as a result. Further, if the connector housings are fitted completely, the coiled springs 16 return to approximately their natural length and, as a result, the spring force does not exert a separating force on the connector housings when they are in a completely fitted state. Moreover, in the present configuration the locking arm 11 and the coiled springs 16 which have been inserted into the spring holder 15 are all inserted into the female connector housing 5 and the male connector housing 1 is provided merely with the stopping protrusion 2 which engages the locking arm 11 (ribs 3 are provided in the present embodiment, but these could be omitted and a portion of the male connector housing could push the coiled springs 16). As a result there is little change required from the male connector housing 1 and the configuration currently in use. Consequently there is greater degree of design freedom for this connector housing.

In the present embodiment the spring holder 15 can move in an anterior-posterior direction, allowing fitting detection or release of the spring force. The fitting together of the guiding rails 19 and the groove members 20 allow this movement of the spring holder 15 to take place extremely smoothly.

The spring holder 15 is provided with supporting arms 32 which restrain the backwards movement of the spring holder 15 until immediately prior to the completely fitted state being achieved. As a result, the spring holder 15 will not retreat inadvertently and accordingly its movement is reliable.

Furthermore, the present invention may be embodied in the following ways without deviating from the scope thereof.

(1) in the present embodiment the spring force of the coiled springs 16 is released by pushing back the spring holder 15. Instead, however, the coiled springs 16 may be provided with a restraining means which keeps the coiled springs 16 restrained from their posterior ends and which can release them when the completely fitted state is reached. That is, it is possible to provide a restraining and releasing means which utilises the returning movement of the locking arm 11 to carry out the restraining and release of the coil springs 16.

(2) The present embodiment uses coiled springs 16. However, plate springs or other spring means may also be used.

(3) Further, the spring holder 15 and the locking arm 11 need not be provided on the female connector housing 5 but may equally well be provided on the male connector housing 1.

(4) The spring seats 28 may be independent, and not linked to constitute a spring pushing member 26.

What is claimed is:

1. A fitting detecting connector having a housing, a bendable latch arm provided on the housing and releasably engageable over a protrusion of a mating connector, a spring provided in said housing, said spring being engageable by a mating connector to push apart said detecting connector and a mating connector until said latch arm is in use engaged, and a spring holder on said housing and movable relative thereto, said spring holder engaging the spring, and said spring holder being engaged by and moving with said latch arm when said latch arm is bent during fitting of the detecting connector with a mating housing to compress the spring, and being released by the latch arm when the detecting connector is fully fitted with the mating connector whereby the spring is released from pushing the connectors apart.

2. A connector according to claim 1 wherein said spring holder includes an abutment directly engageable by said latch arm.

3. A connector according to claim 1 wherein said spring holder is slidable in the fitting direction relative to said housing.

4. A connector according to claim 2 wherein said spring holder is slidable in the fitting direction relative to said housing.

5. A connector according to claim 1 wherein said spring holder includes releasable retention means engageable with said housing to prevent relative movement thereof, said retention means being releasable on initial fitting engagement with a mating connector.

6. A connector according to claim 5 wherein said retention means comprises a resilient latch arm engageable with an abutment of said housing, and having a nose engageable by the periphery of a mating connector to release said latch arm.

7. A connector according to claim 1 wherein said resilient means is engageable by the periphery of a mating connector.

8. A connector according to claim 1 wherein said resilient means comprises coil springs arranged in the fitting direction on either side of said latch arm.

9. A connector according to claim 8 wherein said coil springs include respective spring seats engageable by a mating connector.

10. A connector according to claim 9 wherein said spring seats are provided on a common pushing member, the pushing member being engageable by a mating connector.

11. A connector according to claim 9 wherein movement of said spring seats away from said reaction member is limited by abutment members of said spring holder.

12. A connector according to claim 10 wherein movement of said spring seats away from said reaction member is limited by abutment members of said spring holder.

13. A connector according to claim 1 wherein said spring holder partly overlies said latch arm.

* * * * *